US007914391B2

(12) United States Patent
Crealese

(10) Patent No.: US 7,914,391 B2
(45) Date of Patent: Mar. 29, 2011

(54) GOLF SWING TRAINING DEVICE

(75) Inventor: Steven J. Crealese, Matthews, NC (US)

(73) Assignee: Golf Geometrics, LLC, Matthews, NC (US)

( * ) Notice: Subject to any disclaimer, the term of this patent is extended or adjusted under 35 U.S.C. 154(b) by 34 days.

(21) Appl. No.: 12/398,176

(22) Filed: Mar. 4, 2009

(65) Prior Publication Data

US 2009/0227385 A1 Sep. 10, 2009

Related U.S. Application Data

(60) Provisional application No. 61/033,711, filed on Mar. 4, 2008, provisional application No. 61/042,241, filed on Apr. 3, 2008.

(51) Int. Cl.
*A63B 69/36* (2006.01)

(52) U.S. Cl. ..... 473/268; 473/218; 473/257

(58) Field of Classification Search ..... 473/219, 473/257, 261, 262, 264, 266, 268, 269, 270, 473/422, 218

See application file for complete search history.

(56) References Cited

U.S. PATENT DOCUMENTS 1,091,186 A * 3/1914 Brown ..... 33/227
3,853,325 A * 12/1974 Easterbrook ..... 473/268
5,211,400 A * 5/1993 Hall et al. ..... 473/268
5,375,844 A * 12/1994 Waud ..... 473/268

* cited by examiner

*Primary Examiner* — Nini Legesse
(74) *Attorney, Agent, or Firm* — Tillman Wright, PLLC; James D. Wright; Chad D. Tillman

(57) ABSTRACT

A golf swing training device includes a base, an extension bar, and a grid assembly. The grid assembly includes a grid and a putting flange. The grid assembly further includes a grid adjuster connecting the grid and putting flange to the extension bar. An alignment rod is removably coupled to the base.

35 Claims, 10 Drawing Sheets

GOLF SWING TRAINING DEVICE

CROSS-REFERENCE TO RELATED APPLICATION

The present application is a U.S. nonprovisional patent application of, and claims priority under 35 U.S.C. §119(e) to, U.S. provisional patent application Ser. No. 61/033,711, filed Mar. 4, 2008, and U.S. provisional patent application Ser. No. 61/042,241, filed Apr. 3, 2008. Each such provisional patent application is incorporated by reference herein.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE PRESENT INVENTION

1. Field of the Present Invention

The present invention relates generally to golf swing training devices, and, in particular, to devices allowing a user to witness any head movement during any golf swing or putt, aiding in the alignment of the body and golf club and the position of the eyes during the golf swing and putt, respectively, aiding in the achievement of the desired ball position in the stance, and training the golfer to make a fundamentally proper golf swing.

2. Background

It can be appreciated that the act of playing golf requires that the head usually be held quite steady, that the body and clubface be aligned parallel with and perpendicular to the target, respectively, that the shoulders turn on a proper inclined plane, that the hips turn rather than sway, that the swing is initiated with a proper takeaway, and that the golf ball be positioned at a specific location in the stance. In addition, it can be appreciated that the act of putting in golf requires a stationary head with the eyes placed directly over the ball or aligned directly over the line of play while striking the putt. Currently, a golfer may use video equipment or require an instructor or other person present to help verify if the head moves during the swing, or if the body and/or the clubface is aligned properly, or if the golf ball is positioned properly in the stance, or if the eyes are directly over the line of a putt, or if the head moves during the putt, because all of these issues are germane to learning, performing, and reproducing fundamentally proper, effective, accurate, and rewarding golf shots. It is also true that video taping of, instruction of, and observation of a golfer have some limitations in improving that golfer's swing mainly because the golfer receives no real-time feedback during the actual swing or putt and, secondly, because the golfer typically has no video equipment, no professional instructor, and no helpful observer to continue the training often enough.

The device is an ever-available personal golf swing trainer that demonstrates to the golfer, in real-time, any lateral, vertical, and/or forward to backward head movement that occurs during the full, normal golf swing, chip or putt whether practicing or actually striking the golf ball. It trains the golfer to keep a steady head and to place the eyes directly over the ball or line of play while putting. It teaches the golfer to make a proper body turn, both the shoulder plane turn and the hip turn, during the entire pre-impact swing, maintaining the body and spine angles established at address. It is an alignment and real-time feedback device that teaches the golfer proper body and golf club alignment as well as proper golf ball position in the stance and to make a fundamentally and technically correct golf swing. It can be used on any surface and, when used on turf, multiple divots can be taken without the need to move or adjust the device. Its purposeful design and dimensions make it easy to carry, assemble, set up, use, disassemble if desired, and, importantly, to adjust to any golfer.

SUMMARY OF THE PRESENT INVENTION

The present invention provides a golf swing training device. Broadly defined, the present invention according to one aspect includes a base which rests on the grass, mat, or floor on the opposite side of the golf ball from where the user stands. It has an extension bar extending out of the base and which angles upward and toward the golfer. Attached to the extension bar is an adjustable extension arm at the end of which is attached a see-through grid which is perpendicular to the extension arm.

The present invention according to another aspect is a golf swing training device, including: a base defining at least a portion of a preferred golf swing path; an extension assembly extending upward from the base; and a grid, supported by the extension assembly such that the grid is adapted to be superimposed in the field of vision of a golfer, in close juxtaposition to a stationary golf ball lying on the ground adjacent the base, while the golfer engages in one or more portions of a golf swing.

In a feature of this aspect, the extension assembly is an extension bar having two legs extending upward from the base and toward the golfer at an acute angle relative to the ground.

In another feature of this aspect, the extension assembly includes a horizontal support member, substantially parallel to the preferred golf swing path portion defined by the base, that supports the grid such that the grid may be adjusted along the horizontal support member. In a further feature, the grid is part of a grid assembly that also includes a grid adjuster that slides along the horizontal support member of the extension assembly to facilitate adjustment of the grid along the horizontal support member.

In another feature of this aspect, the grid is part of a grid assembly that also includes a grid adjuster coupling the grid to the extension assembly, thereby enabling the grid to be repositioned within a plane that is perpendicular to the preferred golf swing path portion. In further features, the grid adjuster enables the grid to be rotated relative to an upper end of the extension assembly, thereby permitting the location of the grid to be adjusted in correspondence to a height of a golfer; and the grid adjuster includes a sleeve that is at least partially cylindrical and which is rotatable about a cylindrical portion of the extension assembly.

In another feature of this aspect, the grid includes at least two substantially perpendicular but coplanar linear elements forming an "X," thereby providing a visual reference for the golfer. In further features, one of the at least two linear elements is substantially parallel to the preferred golf swing path portion defined by the base; and the grid includes at least two first linear elements that are parallel to each other and to the preferred golf swing path portion defined by the base, wherein the grid further includes at least two second linear elements that are perpendicular to, but coplanar with, the first linear elements, and wherein each of the first linear elements forms an "X" with each of the second linear elements. In an additional or alternative feature, the grid further includes a substantially circular opening through which the golf ball may be viewed by the golfer when the ball is lying on the ground adjacent the base and the golfer is engaging in one or more portions of a golf swing.

In another feature of this aspect, the grid includes a substantially circular opening through which the golf ball may be viewed by the golfer when the ball is lying on the ground adjacent the base and the golfer is engaging in one or more portions of a golf swing.

In another feature of this aspect, the base is substantially planar relative to the ground and is "U"-shaped in form, wherein the "U" includes two legs and a bottom, wherein the open side of the "U" faces toward the golfer, and wherein the extension assembly extends from ends of the legs. In a further feature, the spacing between the legs of the "U" shape of the base corresponds to the distance between the golfer's hip joints.

In another feature of this aspect, the grid is part of a grid assembly that also includes at least one grid arm extending upward from an upper end of the extension assembly, wherein the grid is supported at an upper end of the grid arm. In a further feature, the at least one grid arm includes two grid arms, and wherein the grid is substantially planar and perpendicular to at least a portion of each of the two grid arms.

In another feature of this aspect, the grid is comprised of a plurality of linear elements having a width of no greater than ⅛ inch. In a further feature, the linear elements are formed from metal wire.

In another feature of this aspect, the golf swing training device further includes a planar flange, wherein the grid is substantially planar and wherein the planar flange extends perpendicularly from the planar grid. In further features, the golf swing training device further includes an alignment rod supported by the base in substantially parallel relationship to the preferred golf swing path portion defined by the base; the alignment rod is removable from the base; and the base include at least one opening penetrating therethrough in which the alignment rod is removably supported.

The present invention according to another aspect is a golf swing training device, including: a base, defining at least a portion of a preferred golf swing path and having a proximal portion and a distal portion, adapted to be positioned on the ground adjacent to a stationary golf ball but on the opposite side of the ball from a golfer preparing to strike the ball such that the proximal base portion faces the ball and the golfer and the distal portion faces away from the ball and the golfer; an extension assembly extending upward from the base and laterally toward the golfer, beyond the lateral extent of the proximal portion of the base, when the golfer is preparing to strike the golf ball, such that an upper end of the extension assembly is supported over the golf ball; and a visual reference structure, supported by the extension assembly such that the visual reference structure is adapted to be superimposed in the field of vision of the golfer, in close juxtaposition to the stationary golf ball lying on the ground adjacent the base, while the golfer engages in one or more portions of a golf swing.

The general purpose of the present invention, which will be described subsequently in great detail, is to provide a golfer real-time feedback on a golf swing. The golfer adjusts the grid piece and/or the position of the device itself so that the golf ball lies in such a position that it can be seen through or adjacent to the grid as the golfer takes the normal golf stance. Since the grid is superimposed upon or adjacent to the golfer's line of sight to the ball it acts as a highly sensitive, real-time gauge of any head movement that occurs during the swing. With this type of real-time feedback a proper golf swing can be learned more quickly since keeping the head steady forces one to make the proper body movements which result in a more fundamentally sound golf swing. The device also possesses other purposefully incorporated geometric features which play a significant role in guiding the user toward, again, a more fundamentally sound golf swing.

To attain fundamentally sound golf swings in various situations, in one or more embodiments, the present invention has the following elements: a perpendicular flange on the grid, and an alignment rod. For putting, the edge of the grid which is closest to the golfer has a perpendicular flange. When the grid is exactly parallel with the ground, the upper edge of the flange and the edge of the grid closest to the golfer will be perfectly on the same vertical plane. Therefore, the golfer places the ball under this part of the grid so that when looking downward through the superimposed flange and grid edge, the eyes are directly over the ball or the line of the putt. The base of the device has an alignment rod which allows the golfer to set the feet, hips, and shoulders parallel with the target line while the grid allows the golfer to set the clubface perfectly perpendicular to the target line. The vertical elements of the grid also allow the golfer to easily and accurately determine and adjust, if desired, the location of the golf ball in the stance. The alignment rod also serves as a visual guide for the proper shoulder turn and takeaway in initiating and performing the backswing. The alignment rod can be decoupled from the base and used in various ways to aid in alignment of the body and as a more proximal visual guide for the putterhead during putting practice. The adjustability and adaptability of the design allows golfers of all skill levels and with any swing idiosyncrasies to use it and benefit from it.

In at least one embodiment, the golf swing training device can be and is used as a device to keep the head steady while hitting a chip shot or a bunker shot or to aid in teaching these shots to a golfer. It can and is intended to also be used frequently without the presence of a golf ball but with the golfer using another point of reference on the ground or floor (i.e.: golf tee, blade of grass, mark on the carpet, etc.) while making/practicing golf swings and not moving the head. It can be used by a golf professional in giving golf instruction. To be clear, it can and is meant to be used while simulating partial golf swings, while making less than full-speed complete golf swings, and while making a normal, full-speed golf swing and striking an actual golf ball.

The base could be a square, rectangle, quadrangle, triangle, circle, 2-sided v-shape, or any other geometric shape as long as it provides a stable footing for the structures that extend upward and away from it. The base, however, in its current configuration possesses two legs which also rest on the ground and which are approximately 8 inches apart between their centers, approximately 7 inches apart between their inner edges, and approximately 9 inches apart between their outer edges for the intended purpose of being the same approximate distance apart as the average human hip joints. The base legs are, in part, designed to serve as a visual point of reference as the golfer learns to turn weight into the hips rather than allowing them or purposefully causing them to sway.

The base of the device could either rest on the ground, be designed to stick into the ground, or consist of leg-like structures such as a tripod.

The base could also be constructed so that it itself possesses the extension piece(s) which connects to a grid or itself serves as the intermediate point of reference between the eyes and the golf ball with or without a grid.

The device could be constructed even without a grid but with any type of structure, whether transparent or not, that is placed adjacent to or intersecting with the line of sight from the eyes to the ball.

The device could be made in any way that would place any object, fiber-optic filament or cable, or a laser beam close to or intersecting with or superimposed upon the line of sight from the eyes to the golf ball.

The base, or the entire device, if made in one piece, could be made from any wood, any metal, any plastic, any rubber, or any composite material.

The extension bar, if it be a separate part from the base, could be made from any wood, any metal, any plastic, any rubber, or any composite material. The extension bar, however, in its current configuration is purposefully angled toward the golfer in part so that it can be used, for example, as a visual reminder for the golfer to turn the shoulders on an inclined plane, rather than on a flatter plane, during the golf swing. The extension bar is also inclined in order to help facilitate use of the device without the ball having to be placed too close to the base. The extension bar also possesses a horizontally oriented portion which serves as the connection point for the grid assembly. This horizontal portion of the extension bar has purposeful length to it so that, for example, the grid assembly can not only be rotated around it but so the grid assembly can also be slid and positioned at different points along the horizontal length of the extension bar. This allows re-positioning of the grid as an option rather than moving the entire device when the device is being used on turf. It also allows different positions of the grid along the length of the horizontal aspect of the extension bar to accommodate golfers of different skill levels so that poorer golfers' swing and ball striking tendencies do not damage the device.

The grid, its "arms", and its adjustable attachment, if it be a separate part, could be made from any wood, any metal, any plastic, any composite material, fiber-optic filaments or cable, laser beams, any string, any wire, any twine, any fibrous substance, any glass, any fiberglass, any rubber, any paper, or any other appropriate material.

The grid itself, or any interceding object between or next to the line of sight to the ball, viewed perpendicular to its primary plane, could be square, rectangular, triangular, oval, circular, of any geometric shape, or could consist of between one and any number of simple finger-like projections, whether very small or large gauge and regardless of their length.

The grid could consist of just a perimeter or be gradated in numerous ways or contain concentric circular structures or multiple geometric configurations or a combination of both, all to give the golfer more points of reference to better or best appreciate any movement of the golf ball within or next to the superimposed or adjacent grid.

The grid could be transparent, partially transparent, or made of any opaque substance and contain any patterned characteristic to allow the golfer to detect even the most minimal ball movement within or next to the grid.

The flange on the end of the grid which is used for the purpose of placing the eyes directly over the ball or line of play while putting could instead be constructed below the grid or could be placed on the ground itself, as long as there exist two separated lines in the same vertical plane that are visually superimposed when placing the eyes along that same plane.

The device and its parts could have any dimensions as long as no part of it interfered with the user's body, the swing path of the user's golf club, or the ball itself whether stationary on the ground or in flight after impact.

This device design, however, is unique and novel in that it can be used by any size golfer, with any club, for any shot including a putt, in any place as long as there exists enough room to swing the club, while teaching proper alignment of the body and the golf club, while demonstrating exactly where the golf ball is located in the golfer's stance, while training the golfer to make a proper turn instead of a sway, and while showing the golfer what head movement looks and feels like so that golfer can learn to keep the head steady.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
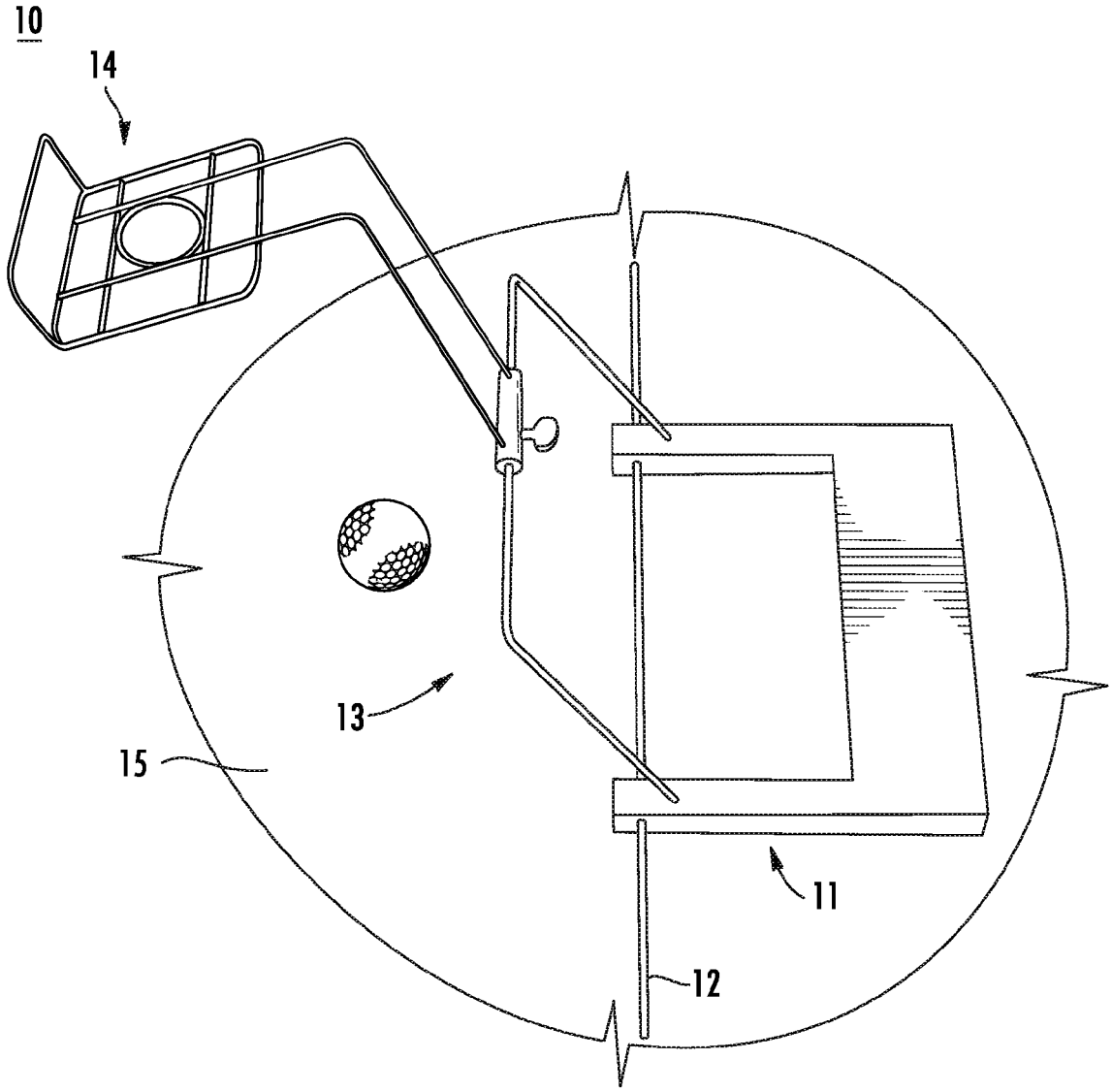
FIG. 1 is a perspective view of a golf swing training device in accordance with the preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

Figure 2:
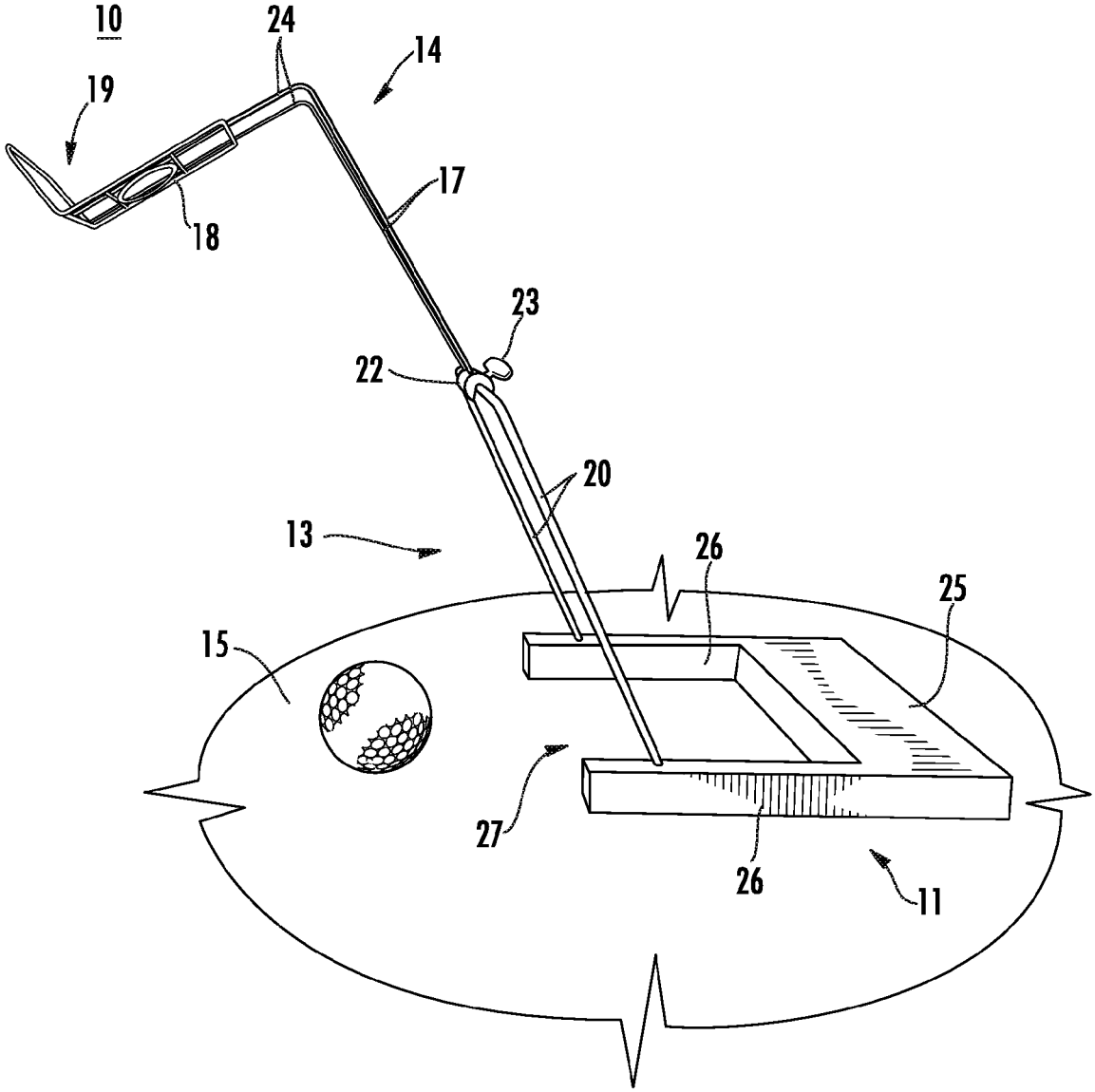
FIG. 2 is a side perspective view of the golf swing training device of FIG. 1, shown without an alignment rod.
Figure 3:
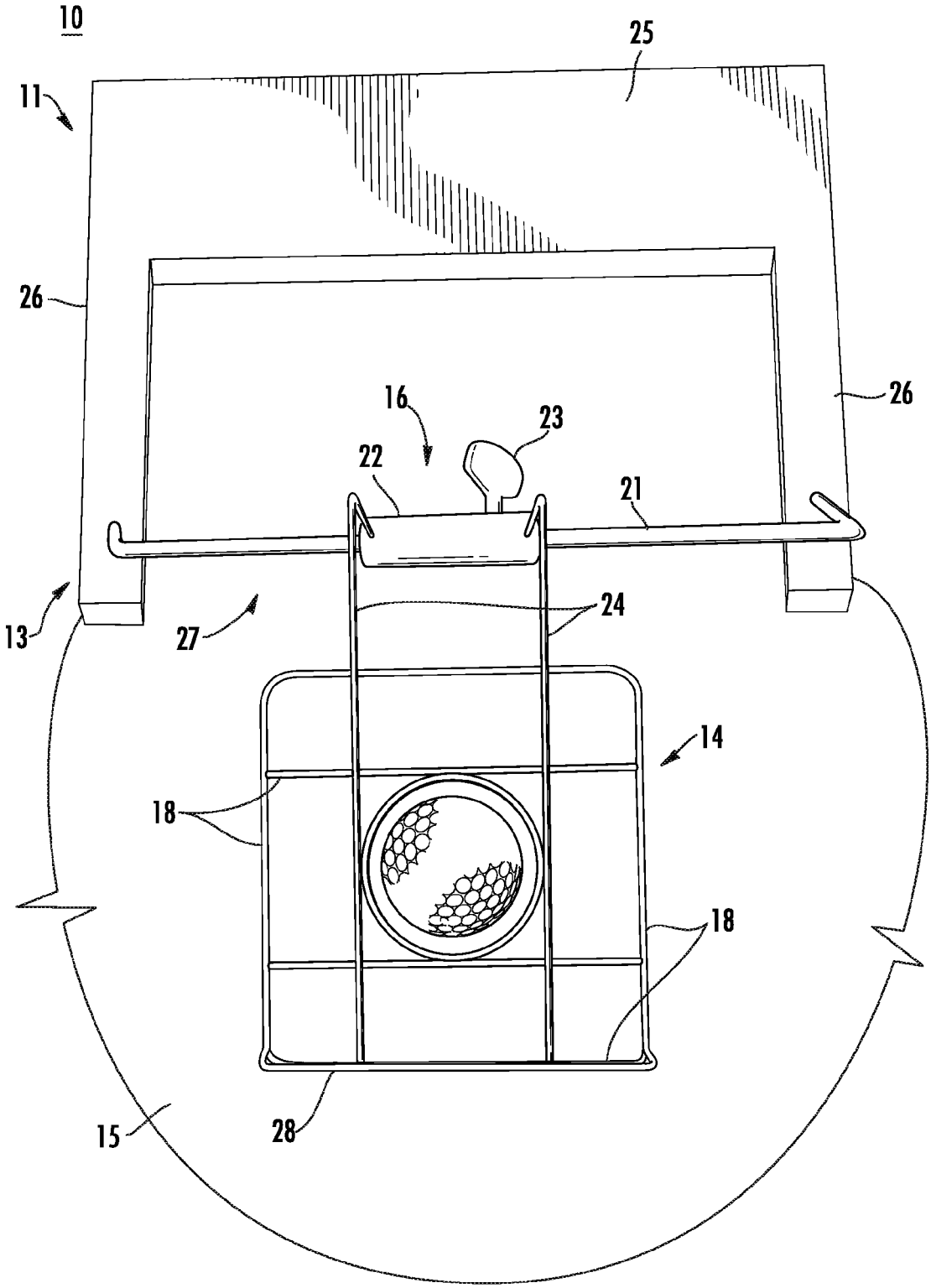
FIG. 3 is a top perspective view of the golf swing training device of FIG. 2.
Figure 4:
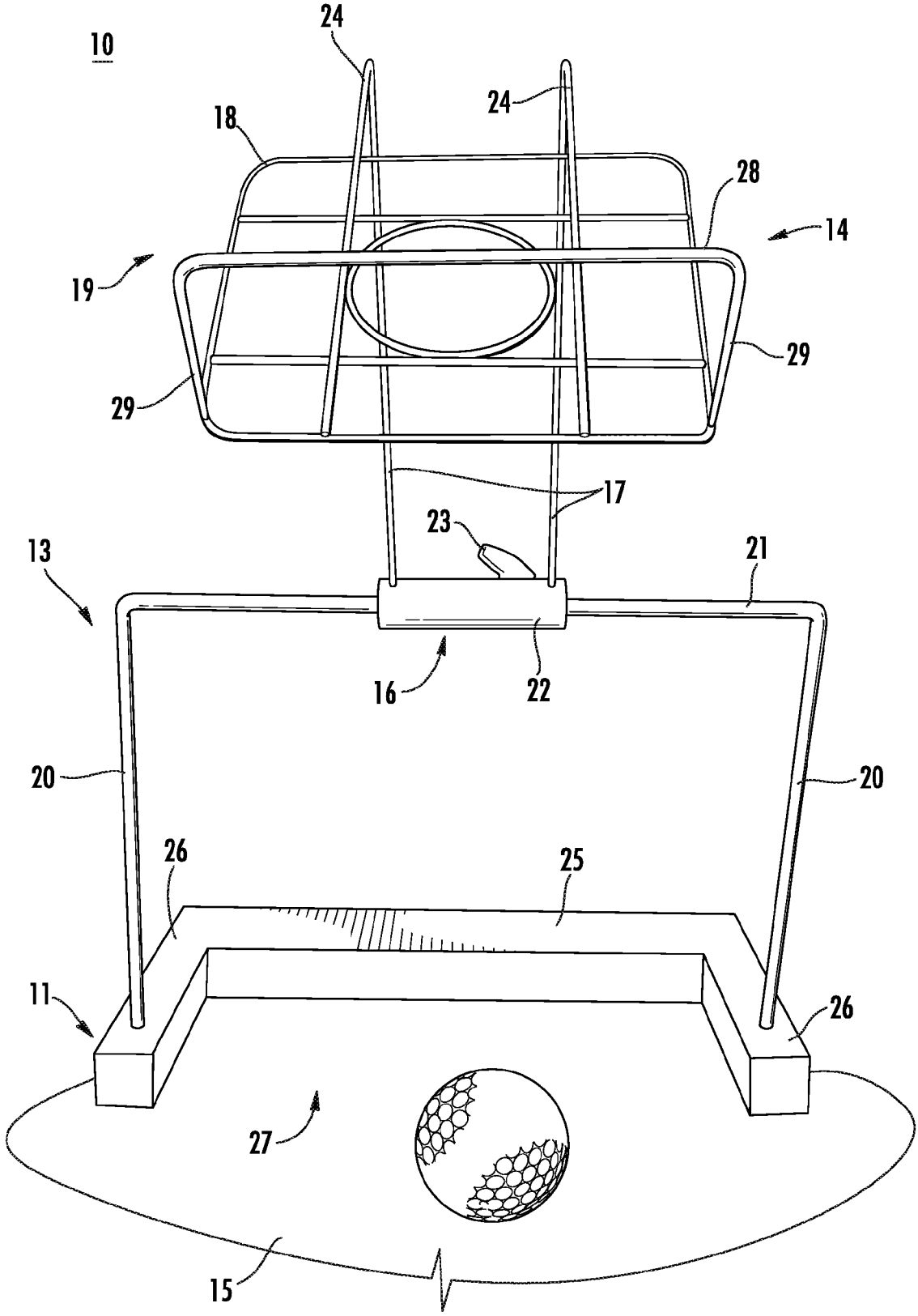
FIG. 4 is a front perspective view of the golf swing training device of FIG. 2.

FIG. 1 is a perspective view of a golf swing training device 10 in accordance with the preferred embodiments of the present invention, and FIGS. 2-4 are a side perspective view, a top perspective view, and a front perspective view, respectively, of the golf swing training device of FIG. 1, shown without the alignment rod of FIG. 1. As shown therein, the device 10 preferably includes a base 11, an alignment rod 12, an extension bar or other extension assembly 13, and a grid assembly 14. The base 11 is adapted to rest on the ground, artificial surface, floor, or the like (hereinafter referred to generically as the "ground" 15) and is preferably counterbalanced to support the extension bar 13 and grid 14. Alternatively, means may be provided to anchor the base to the ground, thereby holding it in place. The alignment rod 12 is coupled to one side of the base 11. In at least one embodiment, the extension bar 13 is supported by the same side of the base 11 as the alignment rod 12 and extends upward to support the grid assembly 14 which is preferably adjustably coupled thereto. Each of these elements will be described in greater detail herein below.

The base 11 is the portion of the device 10 that rests on the ground 15 and provides stability to and an attachment site for the other parts of the device 10 including the alignment rod 12. The base 11 may be made of hard plastic or composite material, is a singular continuous structure, and is in the basic shape of a squared-off "U" with both "legs" 26 of the "U" the same length. The base 11 is constructed along one primary plane, that being parallel with the ground 15. In at least one proposed commercial embodiment, the bottom 25 of the "U" of the base 11, measures approximately 9 inches long, when viewed in its functioning position from side to side, by 2½ inches wide, from its front to its back which is its portion farthest from the golfer, by ¾ to 1 inch tall or up from the ground. The legs 26 of the base 11 are perpendicular to the bottom 25 of the "U" of the base 11 in the plane that is parallel with the ground 15. In at least one proposed commercial embodiment, each of the two legs 26 of the base is approximately 7 inches long, measured from the back of the base toward the golfer or front of the device 10, ¾ to 1 inch wide, in its functioning position from side to side, and ¾ to 1 inch tall or up from the ground 15. The "open" end 27 of the "U" faces the golfer such that the legs 26 of the base 11 point toward the golfer.

An alignment rod 12 extends through openings that are located approximately ½ inch from each end of the legs 26 of the base 11. The rod 12 is preferably substantially straight, is parallel to the "bottom" of the "U" 25, and lies in the same horizontal plane as the base 11. The rod 12 further is sized to extend between the legs 26 and to extend beyond them on either side by approximately 8 inches. The openings are preferably ¼ to ⅜ inch drilled horizontal holes, and the diameter of the alignment rod 12 is commensurate with the diameter of the holes.

In at least one embodiment, the alignment rod 12 is made from metal, hard plastic, or graphite. Approximately 1¼ inches from each end of the legs 26 of the base 11 (the ends that are closest to the golfer) are two holes, one in each leg 26. These holes are located through the top surface of each leg 26 and down into each leg 26. In one embodiment, the holes penetrate into the legs 26 at a 90 degree angle relative to the surfaces of the legs 26, while in another embodiment, the holes are angled into the legs 26 at a 120 degree angle relative to the length of each leg 26 toward the bottom 25 of the base 11, or "U". These holes may or may not penetrate completely through the legs 26 but in at least one embodiment are ½ to 1 inch deep and, together, serve as the attachment site for the extension bar 13. At least partly because the extension bar 13 and the grid assembly 14 collectively extend more than a foot upward and well outside the vertical boundary of the base 11 perimeter and will, therefore, exert a torsion-like force on the base 11, the base 11 is preferably of sufficient weight and of specific design to keep the entire device 10 stable and prevent it from becoming top-heavy and tipping over when in any of its functional positions.

As noted previously, the alignment rod 12 is preferably substantially straight, if not perfectly straight, and, in at least one embodiment, is approximately 24 to 25 inch long metal, hard plastic, or graphite, solid or hollow cylindrical bar with a cross-sectional diameter along its entire length of approximately ¼ to ⅜ inches. The alignment rod 12 may be one continuous piece or may be made of separate pieces (such as, for example, three separate pieces) which assemble and/or telescope, like an antenna, to effectively produce the substantially straight rod described. The alignment rod 12 inserts through the ¼ to ⅜ inch in diameter drilled holes that are approximately ½ inch from the ends of the legs 26 of the base 11 and are horizontally oriented and parallel to the bottom 25 of the base 11. The alignment rod 12 allows the device 10 to very accurately be aligned with any close or distant target and allows the golfer to then place the feet, hips, and shoulders parallel with that target line, all resulting in proper alignment and aim for the ensuing golf swing/shot. As will be appreciated, learning and performing proper alignment is very important to developing an effective golf swing and an accurate golf shot. The device 10 is unique and novel for at least the reasons that not only does the alignment rod 12 aim at the intended target and direct the golfer to position the body properly at address, but its grid assembly 14 possesses purposefully designed elements that are substantially perpendicular to the alignment rod 12, thereby allowing the golfer, with the grid 18 in the field of vision, to also position or align the leading edge of his or her club perfectly perpendicular to the line of flight. The elements of the grid 18 also allow the golfer to know exactly where the golf ball is located in the stance.

The extension bar 13 is mounted to the ends of the legs 26 of the base 11. The extension bar 13 includes two legs 20 and a horizontal support member 21, sometimes referred to as the base of the extension bar 13. The legs 20 are the portion of the extension bar 13 that insert into the base 11 via the holes that are located near the end and through the top surface of the legs 26 of the base 11. In one embodiment, the extension bar 13 is constructed in one plane and is also a squared-off U-shaped continuous singular structure whose legs 20 and horizontal support member or base 21 are all the same length (in at least one proposed commercial embodiment, approximately 7½ to 8 inches) with a 90 degree angle between the horizontal support member 21 and each leg 20. In another embodiment, however, each leg 20 includes a short end section that is bent at a 150 degree angle relative to the rest of the leg 20. The former embodiment may be particularly useful with base legs 26 whose mounting holes are angled, as described previously, while the latter embodiment may be particularly useful with base legs 26 whose mounting holes penetrate into the base legs 26 at a 90 degree angle, also as described previously. In either case, the extension bar 13 may be made out of metal or hard plastic and has a cylindrical cross-section with a diameter of ⅛ inch to ¼ inch. The legs 20 of the extension bar 13 each insert into one of the holes of each leg 26 of the base 11 forming an approximate 60 degree angle with the base 11 so that the horizontal support member 21 of the now "inverted" extension bar 13 leans toward the golfer. The extension bar 13 purposefully extends upward and toward the golfer and away from the base 11 so that enough clearance is ultimately achieved that the golf club, when swung, will not strike or damage the device 10 or any part of the device 10 including the grid assembly 14. The horizontal support member 21 of the extension bar 13 serves as the attachment site of the grid assembly 14 via the grid adjuster 16, which may be a thumbscrew type or other adjustable mechanism which is part of the grid assembly 14. The extension bar 13 and the grid adjuster 16 are preferably designed so that the grid assembly 14 can slide horizontally along nearly the full length of the extension bar's 13 horizontal support member or base 21 and so that the grid assembly 14 can rotate around the length of the extension bar's 13 base 21. This feature is one reason the device 10 is unique and novel in that it adapts perfectly and without exception to every height golfer and with any selected club, including the putter.

The grid assembly 14 preferably comprises five sections, including the grid adjuster 16, a pair of grid arms 17, a pair of parallel appendages 24, the grid 18 itself, and a putting flange 19, which can be constructed as one piece or as two separate pieces. Whether the grid assembly 14 is one singular continuous piece or two assembled pieces, it also has a thumbscrew mechanism or grid adjuster 16 at the site of the grid assembly's 14 attachment to the extension bar 13. The portion of the grid assembly 14 that attaches to the extension bar 13 is called the "grid adjuster" 16 and includes a grid cylinder 22 and a grid thumbscrew 23. The grid adjuster 16 may be a 2 inch long hollow grid cylinder 22 or tube with an outer cross-sectional diameter of approximately ½ inch and an inner cross-sectional diameter of approximately ⅛ inch to ¼ inch to approximate that particular cross-sectional diameter of the extension bar 13. The grid cylinder 22 is preferably not a closed tube but is open along its length with an approximate ⅛ inch to ¼ inch gap which allows it, along its entire 2 inch length, to snap onto or slide over the extension bar's 13 horizontal support member 21. Through the grid cylinder 22, at the center of its 2 inch length, and approximately 180 degrees around its circular periphery from the center of the ⅛ to ¼ inch gap that runs the length of it, there is one approximately 3/16 inch in diameter perpendicular threaded screw hole extending only into, and not beyond, the center of the grid cylinder 22 and into which screws the grid thumbscrew 23. The grid thumbscrew 23 is of typical thumbscrew design, is preferably of approximately 3/16 inch bore, and secures the grid adjuster 16 to the extension bar 13 and does so in any position along the length of and around the circular periphery of the extension bar's 13 horizontal support member 21. The grid cylinder 22 is made of nylon, hard rubber, hard plastic, or metal and the grid thumbscrew 23 is made of metal or hard plastic.

The grid arms 17 are confluent with and extend perpendicularly from the side of the grid cylinder 22. In at least one embodiment, the grid arms 17 extend from the grid cylinder at a point that is 90 degrees around the circular periphery of the grid cylinder 22 from the center of the ⅛ to ¼ inch gap that runs the length of the grid cylinder 22 and also 90 degrees around the circular periphery of the grid cylinder 22 from the center of the 3/16 inch thumbscrew hole. The two grid arms 17 are preferably substantially straight, and in at least one embodiment are 6 to 7 inches long, are exactly parallel to one another, are approximately 1½ to 1¾ inches apart measuring from their axial centers, are 1/16 to 3/16 inches in diameter along their entire length if cylindrical, are from ⅛ to ¼ inches per side along their entire length if their cross-section is rectangular or square, and either connect to or are continuous with, and at a 90 degree angle, another section of the grid, the parallel appendages 24. The grid arms 17 may be made of nylon, hard rubber, hard plastic, or metal.

The grid arms 17 extend the parallel appendages 24 and the grid 18, both of which exist in the same plane and at 90 degrees to the grid arms 17, upward and away from the extension bar 13 and, therefore, even farther away from the ground 15. These two elevators or extenders of the grid 18 (the extension bar 13 and the grid arms 17) with an adjustable connector between them (the grid adjuster 16) are a purposeful, desirable, and novel design. These unique features virtually guarantee that no part of the device 10 will be damaged by any level golfer during normal and proper use. These features also were consciously engineered into the device 10 so that any combination of any height individual with any length golf club can, without exception, use the device 10, as intended, with a simple adjustment of the grid assembly 14 so that the grid arms 17 are parallel with and the grid 18 is then, by design, perpendicular to the golfer's line of sight. When it is adjusted, as just previously described, for any size golfer with any length golf club the device 10 serves its intended purpose perfectly and will not be obstructive nor suffer damage.

In at least one embodiment, the grid 18 is made entirely of approximately 1/16 inch diameter metal wire, whether soldered, welded, or forged, or approximately 1/16 to 3/32 inch cylindrical or similar shaped hard plastic, molded into one confluent piece, and is a single continuous structure which either hinges with or connects rigidly to the grid arms 17 or is contiguous with them via the parallel appendages 24. If the grid 18 connects rigidly to the grid arms 17 or is contiguous with them, in either scenario via the parallel appendages 24, then the angle of that relationship is substantially exactly 90 degrees. In other words the grid 18 is oriented perpendicular to the grid arms 17. However, the parallel appendages 24, and in effect the grid 18, may hinge relative to the grid arms 17 for the purpose, for example, of folding for easier packaging, storing, and portability. In any event the main plane of the grid 18 is preferably to be perpendicular to the grid arms 17 when the device 10 is being used properly and as intended.

The design of the grid 18 is that of a recognizable grid-like structure with three appendages. The main body of the grid 18 lies in one plane and in at least one proposed commercial embodiment is an approximately 3¼ to 3½ inch square perimeter in the very center of which lies an approximately 1½ inch diameter circle. Parallel to each side of the square, inside each side of the square, and approximately ¾ to 1 inch away from each side of the square are four inner lengths of the grid 18 that are each 3¼ to 3½ inches long and each connect from one side of the square to the opposing side of the square resulting in each laying tangential to the centrally located circle. The result is two pairs of parallel inner lengths with each pair being approximately 1½ inches apart and with each pair being perpendicular to the other pair. Notably, the various elements of the grid 18, other than the centrally located circle, are all substantially parallel or perpendicular to the various other elements of the training device 10, including for example the alignment rod 12, which permits and naturally encourages the clubface to be substantially exactly aligned, and with high assuredness, with the target, thereby permitting the position of the ball in the stance to be ascertained exactly.

One pair of these parallel lengths forms two of the alluded-to appendages, the "parallel appendages" 24, by extending beyond one side of the grid 18, while remaining parallel to one another and perpendicular to that side of the grid 18. The parallel appendages 24 extend beyond the main body of the grid 18 by approximately 1½ inches and become contiguous with or attached to the grid arms 17 at a 90 degree or right angle.

Attached to the exactly opposite side of the grid 18 from where the two parallel appendages 24 connect to the grid arms 17, is a third and final appendage, the putting flange 19. This appendage 19 is a simple three-sided flange 19 with a base 28 that in at least one proposed commercial embodiment is 3¼ to 3½ inches long and two legs 29 that lie in the same plane with each other and the base 28, that are each perpendicular to the base 28, and that each measure approximately 1¼ inches wide or tall. The putting flange 19 is perpendicular to the plane of the grid 18. The ends of the 1¼ inch legs 29 of this putting flange 19 connect with the respective ends or corners of the 3¼ to 3½ inch side of the grid 18 and at a 90 degree or right angle to it. Whereas the grid arms 17 extend perpendicular to the two parallel appendages 24, and, therefore, are perpendicular to the grid 18, toward the extension bar 13, the putting flange 19 extends perpendicular to the opposite side of the grid 18 in the opposite direction, away from the extension bar 13 or away from the grid arms 17. In other words the grid arms 17 and the putting flange 19 both extend perpendicularly from the grid 18 but do so in exactly opposite directions and from exactly opposite sides of the grid 18 and with the grid arms 17 actually connecting to and extending at 90 degrees from the parallel appendages 24.

FIG. 2 shows a ground level view of the device 10 from behind the ball (assuming a right-handed golfer), illustrating the profile of the device 10. It will be appreciated that the alignment rod 12 (and corresponding holes in the legs 26) is absent in this view. The extension bar 13 is angled out of the base 11 at approximately 60 degrees (relative to the floor) toward the golfer while the grid assembly 14 can be adjusted around and along the extension bar 13, although in other embodiments the angle may be varied somewhat. FIG. 3 shows the device with the grid 18 superimposed over the ball from the perspective of the golfer addressing the ball. It will be appreciated that the alignment rod 12 and golf club are absent in this view. FIG. 4 shows the device 10 from ground level, front to back, and illustrates the ground clearance that the extension bar 13 and the grid arms 17 produce.

The putting flange 19 is another unique and novel feature of this device 10 that allows the golfer to practice putting while knowing for certain whether his or her eyes are directly over the ball or line of putt. When the grid adjuster 16 is positioned so that the grid arms 17 are approximately perpendicular to the ground 15, the grid 18 is then parallel with the ground 15 and the putting flange 19, which extends upward at 90 degrees from the grid 18, is also perpendicular to the ground 15. In this position the 3¼ to 3½ inch length of the putting flange 19 lies directly and vertically over the 3¼ to 3½ inch length of the respective edge of the grid 18 allowing the two to become superimposed when the golfer's eyes are directly and vertically over them. The ball is placed directly and vertically under these superimposed lengths and the golfer learns what it looks and feels like to putt with the eyes directly over the ball or line of putt and without moving the head.

FIGS. 5-8 are perspective views of the golf swing training device 10 of FIG. 1, illustrating various methods of use in accordance with the preferred embodiments of the present invention. The base 11 of the device 10 rests flat on the ground 15 and provides complete stability to and an attachment site for the extension bar 13 and, therefore, the rest of the device 10. The alignment rod 12 allows the user to position the device 10 so that it is aligned with a specific target. The extension bar 13 inserts into the base 11 and acts to provide clearance vertically away from the ground 15 and horizontally away from the base 11. The grid assembly 14 attaches to the horizontal support member 21 of the extension bar 13 and is adjustable both along the extension bar's 13 length and around its circular cross-section effectively allowing positioning of the grid assembly 14 anywhere from fully left to fully right and in any degree of rotation around the extension bar 13 to suit any height golfer with any club and to accommodate golfers of all levels of skill and experience without the likelihood of damage to the device 10 or subsequent injury to the golfer. The grid arms 17 provide even greater clearance vertically away from the ground 15 and horizontally away from the base 11.

With the device 10 fully assembled the golfer places the base 11 flat on the ground 15 so that the ends of the base legs 26, through which the alignment rod 12 travels, point toward the golfer and so that the alignment rod 12 points at a chosen target. The golfer chooses any golf club desired and takes a normal stance with the head of the club between the golfer and the alignment rod 12 and at least four inches from the alignment rod 12. The golfer notes the approximate angle of the line of sight to the club head and adjusts the grid assembly 14 using the grid adjuster 16 so that the grid arms 17 run parallel with or more vertical to (but never more horizontal to) the golfer's line of sight. The golfer then reassumes his stance with that particular club and, using a point of reference on the ground (or floor) 15 such as a tee or a piece of grass (or a mark on the carpet) that can be seen through the grid 18 or immediately adjacent to its proximal edge, practices the golf swing while keeping that point of reference focused in the field of vision and still or motionless in relationship to the grid 18.

If during any portion of a golfer's swing (including takeaway, back swing, and the like) the point of reference "moves" in relation to the grid 18 then the user immediately knows that his head actually moved, since both the point of reference and the superimposed or adjacently located grid 18 remained stationary. Since the grid 18, whether superimposed between or adjacent to the line of sight, serves as an intermediate reference point between the ground (or ball) 15 and the eyes, any head movement will disrupt the direct linear relationship from the eyes through or adjacent to a section of the grid 18 and to the ground 15 or ball. Even though the golfer is focusing intently upon the ground 15 or the ball, any "movement" of the grid 18 (or any "movement" of the ball within and relative to the grid 18) during the swing is easily seen and quantified without distracting the golfer from being able to continue to look directly at and focus on the ball or other point of reference on the ground 15.

The grid 18, purposefully, is generally not obstructive to the golfer's view, and peering through it at the golf ball is thus not distracting or difficult. The device 10 simply places an incidental and unobtrusive grid 18 delicately over or next to the line of sight to the ball so that head movement can be very sensitively monitored in real-time during an actual golf swing. As the golfer swings, if the ball "moves" vertically or horizontally in relation to the grid 18 before impact then the head moved vertically or horizontally, respectively, during the pre-impact swing. The golfer sees this occur in real time and quickly learns how to swing the club without allowing the ball to "move" in relation to the grid 18. For less than full shots the same procedure of use applies. The device 10 is simply adjusted to the golfer's line of sight (or more vertically) with that particular club in hand and the golfer can then hit pitch shots, chip shots, or even sand shots (the alignment rod 12 should be removed for sand shots due to the lack of uniformity of the ground 15 in a bunker) with a motionless head.

Figure 5:
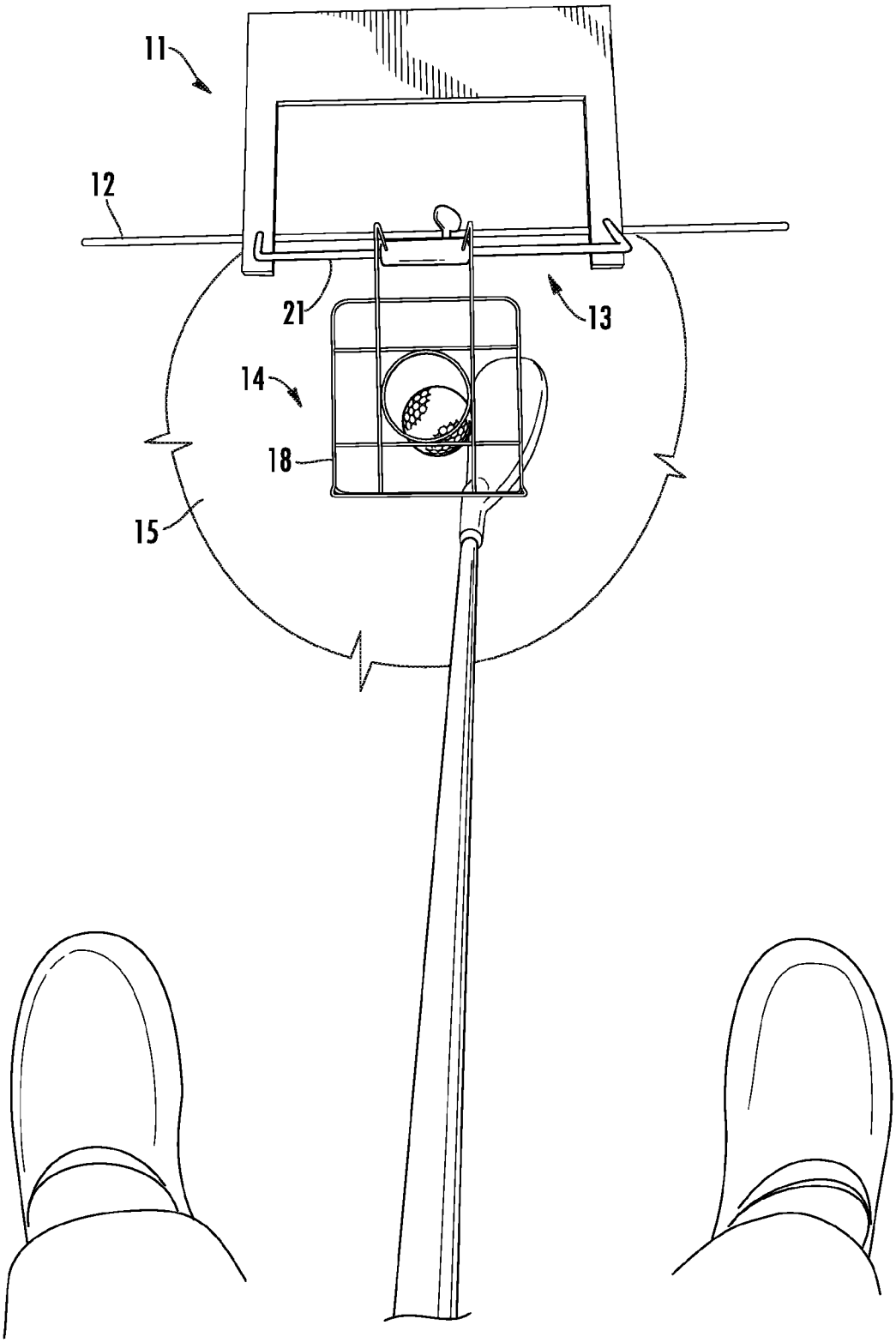
FIG. 5 is a top perspective view of the golf swing training device of FIG. 1, illustrating a first method of use in accordance with the preferred embodiments of the present invention.
Figure 6:
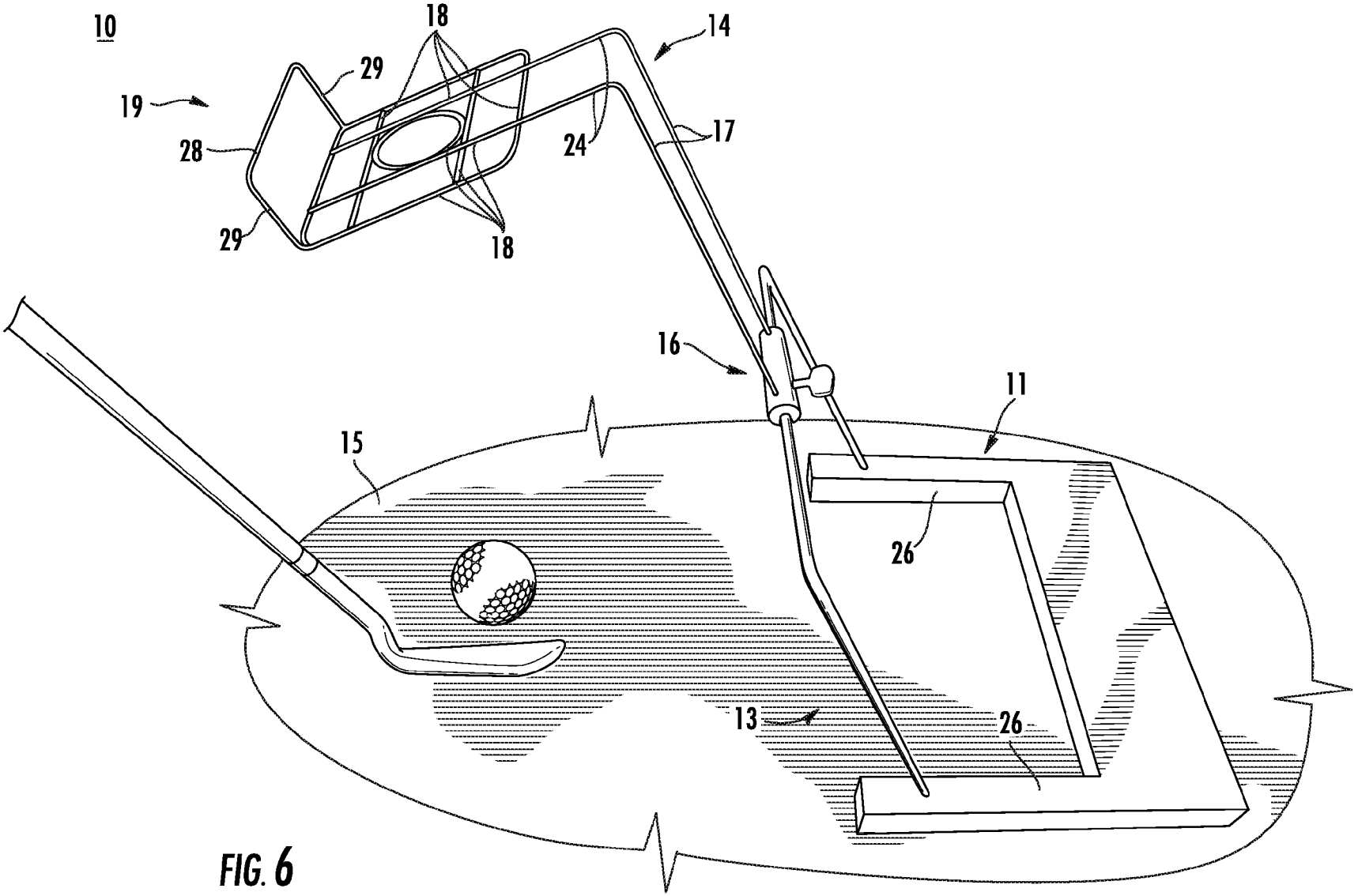
FIG. 6 is a side perspective view of the golf swing training device of FIG. 5.

In particular, FIG. 5 is a top perspective view of the golf swing training device 10 of FIG. 1, illustrating a first method of use in accordance with the preferred embodiments of the present invention, and FIG. 6 is a side perspective view of the golf swing training device 10 of FIG. 5. Referring to FIG. 5, a golfer's feet are seen as aligned with the alignment rod 12. As described previously, it is well known that proper alignment of the body and clubface are crucial in the proper and accurate execution of a golf shot. It is also well known that it is often difficult for a golfer to self-evaluate these alignment issues even though assuming a golf stance and addressing the golf ball. The alignment rod 12 allows the golfer to align the feet, hips, and shoulders parallel with the target, which is proper for an effective golf swing or shot. Also, the leading edge of the clubface may be positioned substantially parallel with one of the vertical elements of the grid 18 and, therefore, substantially perpendicular to the alignment rod 12 and target line. In other words, the leading edge of the clubface is properly aimed directly and accurately at the intended target. The vertical elements of the grid 18 also allow the golfer to easily ascertain the position of the ball between the feet. As illustrated in FIG. 6, it will be appreciated that such an arrangement provides plenty of clearance between the entire device 10 or entire grid assembly 14 and the club shaft.

It will be appreciated that it is not necessary for the ball to be centered under or along the front edge of the grid 18. As is well known, ball position, or where the ball is located in the stance, e.g., in the center, toward the rear foot from center (back in the stance), toward the front foot from center (more forward in the stance) is very important. Some golf instructors feel that ball position should be constant with every club such as between the forward foot and the center of the feet in the region of the more forward armpit, if a vertical line were drawn toward the ground 15 from it. Other instructors feel that ball position can and should vary based on the club being used. They advocate the ball being more forward in the stance for longer shafted clubs, such as the driver, woods, and long irons and the ball being gradually more toward the center of the stance as one goes from mid iron to wedges, with the wedges pretty much in the center of the stance. Regardless of where the player intends the ball to lie in the stance it is difficult at times for the player, while taking a normal stance and addressing the golf ball, to be able to judge it accurately. The vertical elements of the grid 18 are perpendicular to the alignment rod 12 and are easily extended, in the mind's eye, toward the player allowing the player to absolutely know where the ball lies in the stance and to then adjust the stance or the ball position if need be.

Figure 7:
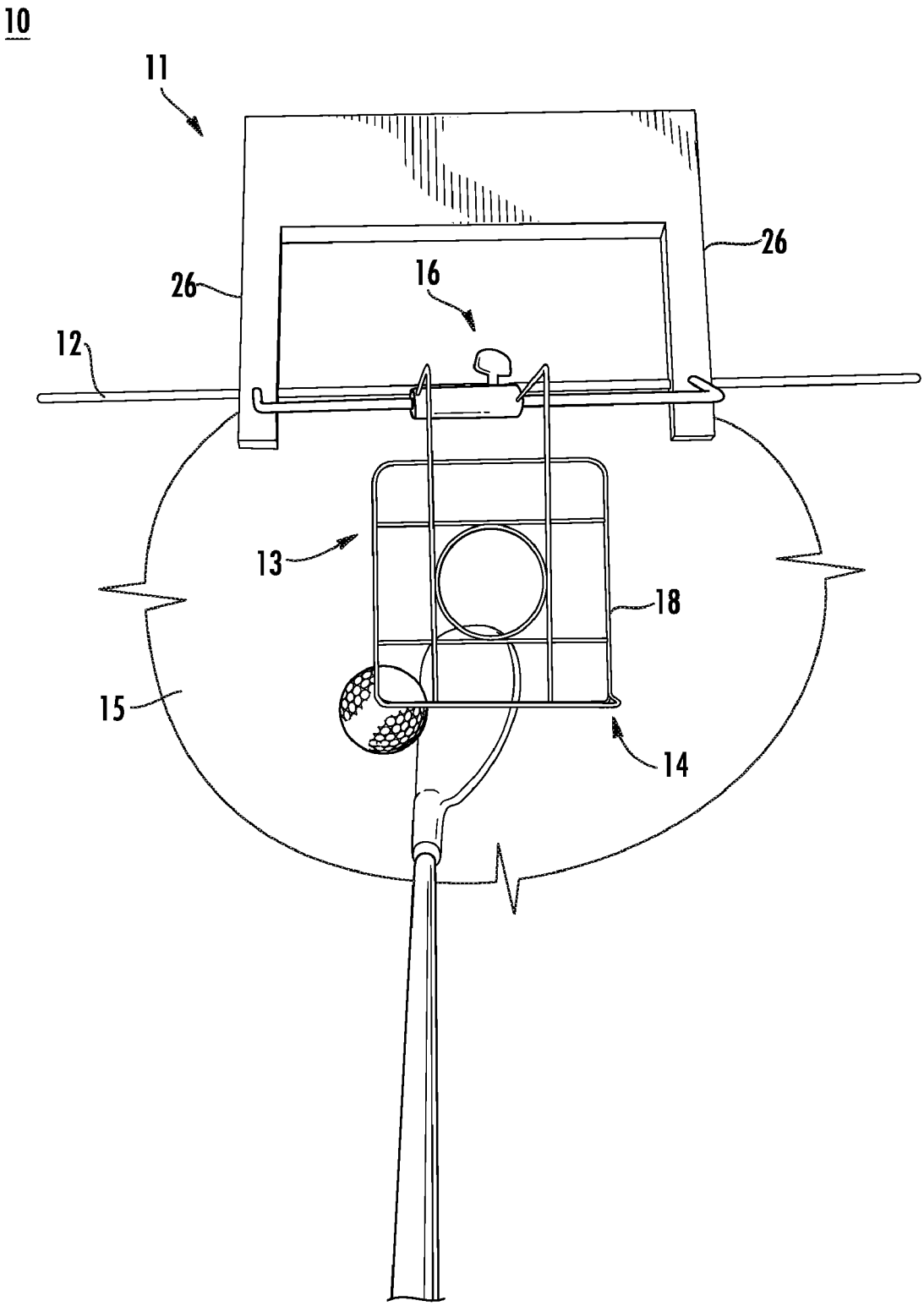
FIG. 7 is a top perspective view of the golf swing training device of FIG. 1, illustrating a second method of use in accordance with the preferred embodiments of the present invention.
Figure 8:
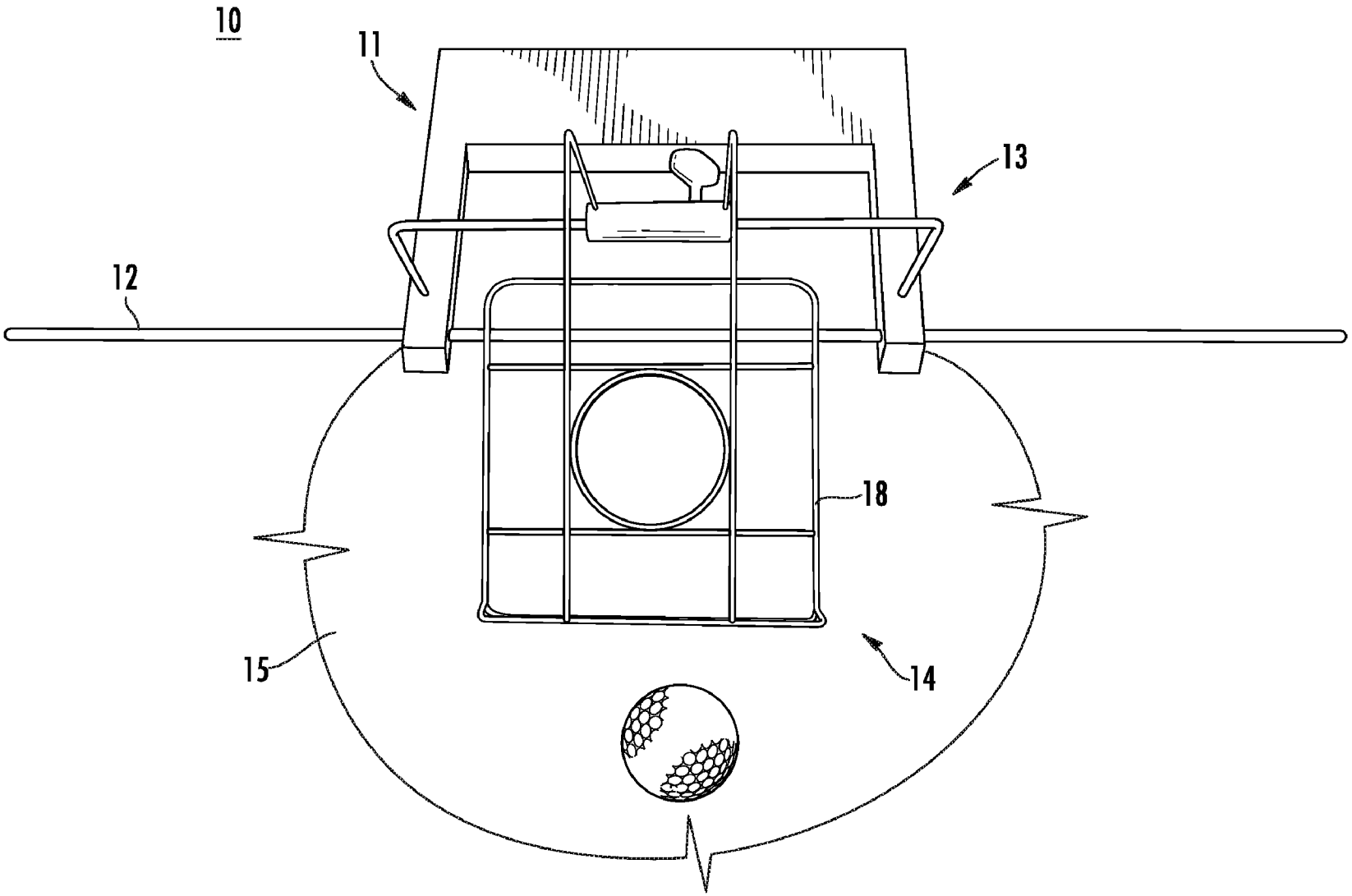
FIG. 8 is a top perspective view of the golf swing training device of FIG. 1, illustrating a third method of use in accordance with the preferred embodiments of the present invention.

In view of the foregoing, FIGS. 7 and 8 are top perspective views of the golf swing training device 10 of FIG. 1, illustrating alternative methods of use in accordance with the preferred embodiments of the present invention. More particularly, FIG. 7 shows how the leading edge of the clubface can be aligned perfectly perpendicular to the alignment rod 12, and thus to the target line/line of flight, using the vertically oriented aspects of the grid 18 which are exactly perpendicular to the alignment rod 12. The feet, hips, and shoulders are set parallel to the alignment rod 12. FIG. 8 illustrates how the ball may be placed outside the grid 18 but a golfer can still use the grid 18 as a reference point above the ground 15 in that head movement will still result in the golfer seeing the ball "move" in relation to the grid 18. This is the way a golfer of poorer skills or a beginner would use the device 10 to be sure the device 10 is not struck by the club or by the ball after it is struck and airborne.

For putting, the grid adjuster 16 is placed so that the grid arms 17 are perfectly vertical, making the grid 18 parallel with the ground 15 and the putting flange 19 vertical or perpendicular to the ground. The golfer places his or her eyes directly over the base 28 of the putting flange 19 to where the base 28 of the putting flange 19 is superimposed over the respective edge of the grid 18. The ball is then placed under the superimposed putting flange 19 base 28 and grid 18 edge. As a result the eyes are directly over or vertical to the ball or over the line of the putt if the golfer prefers to set up with his head behind the ball (along the line of the putt). The golfer then strokes the putt with instant feedback on head movement, since the grid is still also used as a reference point above the ground 15, and while knowing that the eyes were positioned properly over the ball or behind the ball but still over the line of the putt.

Figure 9:
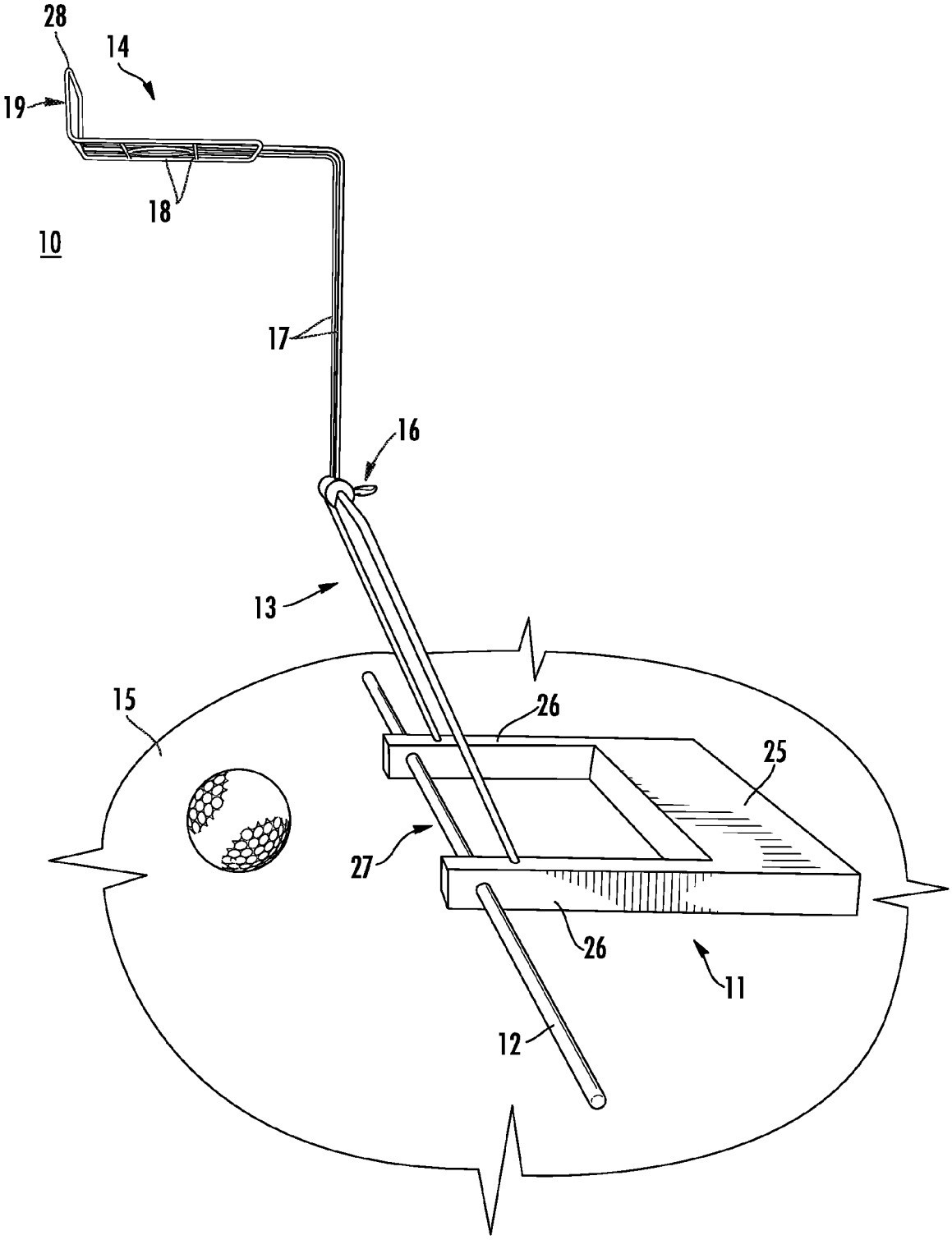
FIG. 9 is a side perspective view of the golf swing training device of FIG. 1, arranged in a putt training mode, illustrating a fourth method of use in accordance with the preferred embodiments of the present invention.
Figure 10:
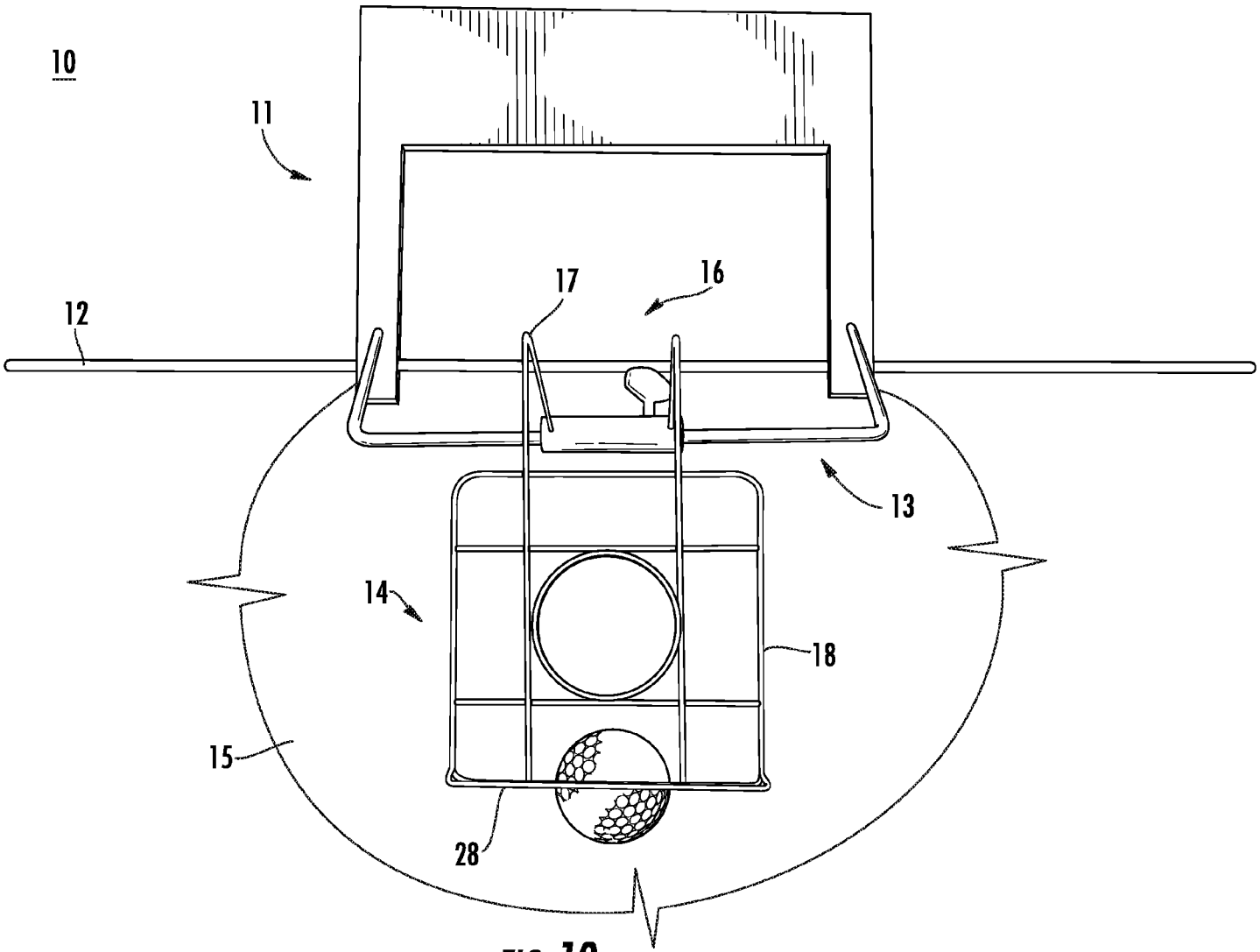
FIG. 10 is a top perspective view of the golf swing training device of FIG. 9.

FIG. 9 is a side perspective view of the golf swing training device 10 of FIG. 1, arranged in a putt training mode, illustrating a fourth method of use in accordance with the preferred embodiments of the present invention, and FIG. 10 is a top perspective view of the golf swing training device 10 of FIG. 9. As shown in FIG. 9, the ball lies directly under and in the same vertical plane as the putting flange 19 and the associated edge of the grid 18. The base 28 of the putting flange 19 and the edge of the grid 18 are superimposed when the eyes are directly vertical to them. The ball is placed so that it is bisected by the vertical plane. FIG. 10 shows the device 10 in putting mode from above with the eyes directly over the putting flange 19 and grid 18 edge which are superimposed over the ball, thereby visually bisecting the ball.

In one or more embodiments, the device 10 can be easily and very quickly assembled and disassembled into its various component parts.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A golf swing training device, comprising:

(a) a base defining at least a portion of a preferred golf swing path;

(b) an extension assembly extending upward from the base; and (c) a grid, supported by the extension assembly such that the grid is adapted to be superimposed in the field of vision of a golfer, in close juxtaposition to a stationary golf ball lying on the ground adjacent the base, while the golfer engages in one or more portions of a golf swing;

(d) wherein the extension assembly includes a horizontal support member, substantially parallel to the preferred golf swing path portion defined by the base, that supports the grid such that the grid may be adjusted along the horizontal support member.

2. The golf swing training device of claim 1, wherein the extension assembly includes an extension bar having two legs extending upward from the base and toward the golfer at an acute angle relative to the ground.

3. The golf swing training device of claim 1, wherein the grid is part of a grid assembly that also includes a grid adjuster that slides along the horizontal support member of the extension assembly to facilitate adjustment of the grid along the horizontal support member.

4. The golf swing training device of claim 1, wherein the grid is part of a grid assembly that also includes a grid adjuster coupling the grid to the extension assembly, wherein the grid adjuster includes a sleeve that is at least partially cylindrical and which is rotatable about a cylindrical portion of the extension assembly.

5. The golf swing training device of claim 1, wherein the grid includes at least two first linear elements that are parallel to each other and to the preferred golf swing path portion defined by the base, wherein the grid further includes at least two second linear elements that are perpendicular to, but coplanar with, the first linear elements, and wherein each of the first linear elements forms an "X" with each of the second linear elements.

6. The golf swing training device of claim 1, wherein the base is substantially planar relative to the ground and is "U"-shaped in form, wherein the "U" includes two legs and a bottom, wherein the open side of the "U" faces toward the golfer, wherein the extension assembly extends from points proximate the ends of the legs, and wherein the spacing between the legs of the "U" shape of the base corresponds to the distance between the golfer's hip joints.

7. The golf swing training device of claim 1, wherein the grid is part of a grid assembly that also includes at least one grid arm extending upward from an upper end of the extension assembly, wherein the grid is supported at an upper end of the grid arm.

8. The golf swing training device of claim 7, wherein the grid is part of a grid assembly that also includes two grid arms extending upward from an upper end of the extension family, and wherein the grid is substantially planar and perpendicular to at least a portion of each of the two grid arms.

9. The golf swing training device of claim 1, further comprising a planar flange, wherein the grid is substantially planar and wherein the planar flange extends perpendicularly from the planar grid.

10. The golf swing training device of claim 9, wherein the grid has a proximate end, supported by the extension assembly, and a distal end from which the planar flange extends.

11. The golf swing training device of claim 1, wherein the device further comprises an alignment rod, and wherein the base includes one or more alignment rod locator features adapted to maintain the alignment rod in substantially parallel relationship to the preferred golf swing path portion defined by the base when the alignment rod is supported by the base and placed in operative relationship with the one or more alignment rod locator features of the base.

12. The golf swing training device of claim 11, wherein the one or more alignment rod locator features include at least one opening, penetrating through the base, in which the alignment rod is removably supported.

13. A golf swing training device, comprising:

(a) a base defining at least a portion of a preferred golf swing path;

(b) an extension assembly extending upward from the base; and (c) a grid, supported by the extension assembly such that the grid is adapted to be superimposed in the field of vision of a golfer, in close juxtaposition to a stationary golf ball lying on the ground adjacent the base, while the golfer engages in one or more portions of a golf swing;

(d) wherein the grid defines a perimeter, at least a side of which defines a straight edge.

14. The golf swing training device of claim 13, wherein the grid includes at least two first linear elements that are parallel to each other and to the preferred golf swing path portion defined by the base, wherein the grid further includes at least one second linear element that is perpendicular to, but coplanar with, the first linear elements, and wherein at least one of the first linear elements forms an "X" with the second linear elements.

15. The golf swing training device of claim 13, wherein the perimeter of the grid is defined by a square, wherein the grid further includes at least one first linear element that is parallel to an edge of the square and to the preferred golf swing path portion defined by the base, wherein the grid further includes at least one second linear element that is perpendicular to, but coplanar with, the first linear element, and forms an "X" with the first linear element.

16. The golf swing training device of claim 13, wherein the extension assembly includes an extension bar having two legs extending upward from the base and toward the golfer at an acute angle relative to the ground.

17. The golf swing training device of claim 13, wherein the grid is part of a grid assembly that also includes a grid adjuster that slides along the horizontal support member of the extension assembly to facilitate adjustment of the grid along the horizontal support member.

18. The golf swing training device of claim 17, wherein the grid adjuster includes a sleeve that is at least partially cylindrical and which is rotatable about a cylindrical portion of the extension assembly.

19. The golf swing training device of claim 13, wherein the base is substantially planar relative to the ground and is "U"-shaped in form, wherein the "U" includes two legs and a bottom, wherein the open side of the "U" faces toward the golfer, wherein the extension assembly extends from points proximate the ends of the legs, and wherein the spacing between the legs of the "U" shape of the base corresponds to the distance between the golfer's hip joints.

20. The golf swing training device of claim 13, wherein the grid is part of a grid assembly that also includes at least one grid arm extending upward from an upper end of the extension assembly, wherein the grid is supported at an upper end of the grid arm.

21. The golf swing training device of claim 20, wherein the grid is part of a grid assembly that also includes two grid arms extending upward from an upper end of the extension family, and wherein the grid is substantially planar and perpendicular to at least a portion of each of the two grid arms.

22. The golf swing training device of claim 13, wherein the device further comprises an alignment rod, and wherein the base includes one or more alignment rod locator features adapted to maintain the alignment rod in substantially parallel relationship to the preferred golf swing path portion defined by the base when the alignment rod is supported by the base and placed in operative relationship with the one or more alignment rod locator features of the base.

23. The golf swing training device of claim 22, wherein the one or more alignment rod locator features include at least one opening, penetrating through the base, in which the alignment rod is removably supported.

24. A golf swing training device, comprising:

(a) a base defining at least a portion of a preferred golf swing path;

(b) an extension assembly extending upward from the base;

(c) a grid that is supported by the extension assembly such that the grid is adapted to be superimposed in the field of vision of a golfer, in close juxtaposition to a stationary golf ball lying on the ground adjacent the base, while the golfer engages in one or more portions of a golf swing; and (d) a flange that is supported above the grid such that the flange is adapted to be superimposed in the field of vision of the golfer, in close juxtaposition to the grid, when the grid is in turn superimposed in the field of vision of the golfer while the golfer engages in the one or more portions of the golf swing.

25. The golf swing training device of claim 24, wherein the grid and the flange are each substantially planar, and wherein the planar flange extends perpendicularly from the planar grid.

26. The golf swing training device of claim 25, wherein the flange is a putting flange that is adapted to be superimposed in the field of vision of the golfer, directly between the grid and the golfer's eyes, when the golfer engages in a golf putting motion.

27. The golf swing training device of claim 24, wherein the extension assembly includes an extension bar having two legs extending upward from the base and toward the golfer at an acute angle relative to the ground.

28. The golf swing training device of claim 24, wherein the grid is part of a grid assembly that also includes a grid adjuster that slides along the horizontal support member of the extension assembly to facilitate adjustment of the grid along the horizontal support member.

29. The golf swing training device of claim 28, wherein the grid adjuster includes a sleeve that is at least partially cylindrical and which is rotatable about a cylindrical portion of the extension assembly.

30. The golf swing training device of claim 24, wherein the grid includes at least two first linear elements that are parallel to each other and to the preferred golf swing path portion defined by the base, wherein the grid further includes at least two second linear elements that are perpendicular to, but coplanar with, the first linear elements, and wherein each of the first linear elements forms an "X" with each of the second linear elements.

31. The golf swing training device of claim 24, wherein the base is substantially planar relative to the ground and is "U"-shaped in form, wherein the "U" includes two legs and a bottom, wherein the open side of the "U" faces toward the golfer, wherein the extension assembly extends from points proximate the ends of the legs, and wherein the spacing between the legs of the "U" shape of the base corresponds to the distance between the golfer's hip joints.

32. The golf swing training device of claim 24, wherein the grid is part of a grid assembly that also includes at least one grid arm extending upward from an upper end of the extension assembly, wherein the grid is supported at an upper end of the grid arm.

33. The golf swing training device of claim 32, wherein the grid is part of a grid assembly that also includes two grid arms extending upward from an upper end of the extension family, and wherein the grid is substantially planar and perpendicular to at least a portion of each of the two grid arms.

34. The golf swing training device of claim 24, wherein the device further comprises an alignment rod, and wherein the base includes one or more alignment rod locator features adapted to maintain the alignment rod in substantially parallel relationship to the preferred golf swing path portion defined by the base when the alignment rod is supported by the base and placed in operative relationship with the one or more alignment rod locator features of the base.

35. The golf swing training device of claim 34, wherein the one or more alignment rod locator features include at least one opening, penetrating through the base, in which the alignment rod is removably supported.

* * * * *